US010932588B2

(12) United States Patent
Dziak et al.

(10) Patent No.: US 10,932,588 B2
(45) Date of Patent: Mar. 2, 2021

(54) SYSTEM, APPARATUS, AND METHOD FOR A CONVERTIBLE CHILD HIGH-CHAIR AND STEP STOOL

(71) Applicant: GRACO CHILDREN'S PRODUCTS, INC., Atlanta, GA (US)

(72) Inventors: Daniel Emil Dziak, Alpharetta, GA (US); Connie Yuanfang Gu, Sandy Springs, GA (US); Shahnaz Selena Kasam, Sandy Springs, GA (US); Ming Cheng Hsu, Taipei (TW); Chiyuan Chen, Taipei (TW)

(73) Assignee: GRACO CHILDREN'S PRODUCTS, INC., Atlanta, GA (US)

( * ) Notice: Subject to any disclaimer, the term of this patent is extended or adjusted under 35 U.S.C. 154(b) by 83 days.

(21) Appl. No.: 16/259,503

(22) Filed: Jan. 28, 2019

(65) Prior Publication Data

US 2019/0231087 A1 Aug. 1, 2019

Related U.S. Application Data

(60) Provisional application No. 62/622,374, filed on Jan. 26, 2018.

(51) Int. Cl.

| | |
|---|---|
| ***A47D 1/00*** | (2006.01) |
| *A47D 1/02* | (2006.01) |
| *A47D 1/10* | (2006.01) |

(52) U.S. Cl.

CPC ..... *A47D 1/006* (2013.01); *A47D 1/004* (2013.01); *A47D 1/0085* (2017.05); *A47D 1/02* (2013.01); *A47D 1/10* (2013.01)

(58) Field of Classification Search

CPC ..... A47D 1/006; A47D 1/0085; A47D 1/004; A47D 1/02; A47D 1/10

(Continued)

(56) References Cited

U.S. PATENT DOCUMENTS

| | | | |
|---|---|---|---|
| 6,033,019 | A | 3/2000 | Hession-Kunz et al. |
| 6,082,814 | A | 7/2000 | Celestina-Krevh et al. |

(Continued)

FOREIGN PATENT DOCUMENTS

| | | | |
|---|---|---|---|
| CN | 203302723 | U | 11/2013 |
| CN | 203314542 | U | 12/2013 |

(Continued)

*Primary Examiner* — Mark R Wendell

(74) *Attorney, Agent, or Firm* — Eversheds Sutherland (US) LLP

(57) ABSTRACT

The convertible child high-chair and step stool can include a frame having a front leg stand and a rear leg stand. A height adjustment mechanism can be coupled to the front leg stand or the rear leg stand and can be adjustable along the vertical axis of the front leg stand or the rear leg stand from a raised position to a lowered position. The apparatus can also include a booster seat and removable platform step. In the raised position, the booster seat can be coupled to the height adjustment mechanism to provide a high chair. In the lowered position, the booster seat can be removed and the removable platform step can be coupled to the height adjustment mechanism and the frame to provide a step stool. The apparatus can also include wheel assemblies coupled to the frame that limit the potential for tip hazards in the step stool configuration.

22 Claims, 10 Drawing Sheets

(58) Field of Classification Search
USPC ..... 297/134
See application file for complete search history.

(56) References Cited

U.S. PATENT DOCUMENTS

| | | | | |
|---|---|---|---|---|
| 7,568,758 | B2 * | 8/2009 | Troutman | A47D 1/002 297/148 |
| 7,673,934 | B2 | 3/2010 | Bearup et al. | |
| 7,918,497 | B2 | 4/2011 | Keegan | |
| 8,567,867 | B2 | 10/2013 | Arnold, IV et al. | |
| 9,788,662 | B1 | 10/2017 | Hollett et al. | |
| 2002/0074835 | A1 | 6/2002 | Chalender | |
| 2003/0218366 | A1 * | 11/2003 | Rho | A47D 1/004 297/153 |
| 2005/0017549 | A1 * | 1/2005 | Chen | A47D 1/0081 297/16.1 |
| 2011/0062753 | A1 * | 3/2011 | Kennedy | A47D 1/0085 297/170 |
| 2011/0227384 | A1 | 9/2011 | Huntsberger et al. | |
| 2016/0007766 | A1 * | 1/2016 | Sack | A47D 1/023 297/16.1 |
| 2016/0174727 | A1 | 6/2016 | Haut et al. | |
| 2016/0367044 | A1 * | 12/2016 | Horst | A47D 1/023 |
| 2017/0251826 | A1 | 9/2017 | Sclare et al. | |

FOREIGN PATENT DOCUMENTS

| | | | |
|---|---|---|---|
| CN | 203619168 | U | 6/2014 |
| CN | 204260361 | U | 4/2015 |
| CN | 105768697 | A | 7/2016 |
| CN | 207012004 | U | 2/2018 |
| WO | 98/01060 | A1 | 1/1998 |

* cited by examiner

SYSTEM, APPARATUS, AND METHOD FOR A CONVERTIBLE CHILD HIGH-CHAIR AND STEP STOOL

RELATED APPLICATIONS

This application claims priority under 35 U.S.C. § 119 to U.S. Provisional Patent Application No. 62/622,374 filed Jan. 26, 2018, and titled "System, Apparatus, and Method for a Convertible Child High Chair and Step Stool," the entire contents of which are hereby incorporated herein by reference for all purposes.

TECHNICAL FIELD

The present disclosure is generally directed to children's high-chairs and more particularly to systems, apparatuses, and methods for providing a high-chair that is convertible to a step stool or step ladder.

BACKGROUND

Children's high-chairs are well-known in the art. The typical children's high-chair is designed to provide an infant, toddler, or child with an elevated seating position when compared to conventional chairs. Typically the high-chair includes a tray or similar device that can be removably coupled to the high-chair and can be used as a place to set down food and/or drinks for the child.

Often when a child gets older, whether they have outgrown the high-chair or not, they want to help their parent(s) with activities in the kitchen. This can include helping with the preparation of meals, cooking meals, and/or cleaning the kitchen. However, in many instances, the child is not yet tall enough to help with these activities. This leaves the parent(s) with a problem. One conventional solution is the parent(s) purchasing a separate step stool, step ladder, or kitchen helper to elevate the child to a height where they can assist their parent(s) while also keeping the child safe. Unfortunately, this results in two separate devices needed to be located within the kitchen area, which typically has limited space, while the child is still using the high-chair. However, when the child no longer needs the high-chair for eating, then it provides no further useful purpose.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF THE EXAMPLE EMBODIMENTS

Example embodiments will now be described more fully hereinafter with reference to the accompanying drawings, in which example embodiments are shown. The concepts disclosed herein may, however, be embodied in many different forms and should not be construed as limited to the example embodiments set forth herein; rather, these embodiments are provided so that this disclosure will be thorough and complete, and will fully convey the scope of the concepts to those skilled in the art. Like numbers refer to like, but not necessarily the same or identical, elements throughout.

Certain relationships between features of the convertible high-chair and step stool are described herein using the term "substantially" or "substantially equal". As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom.

Figure 1A:
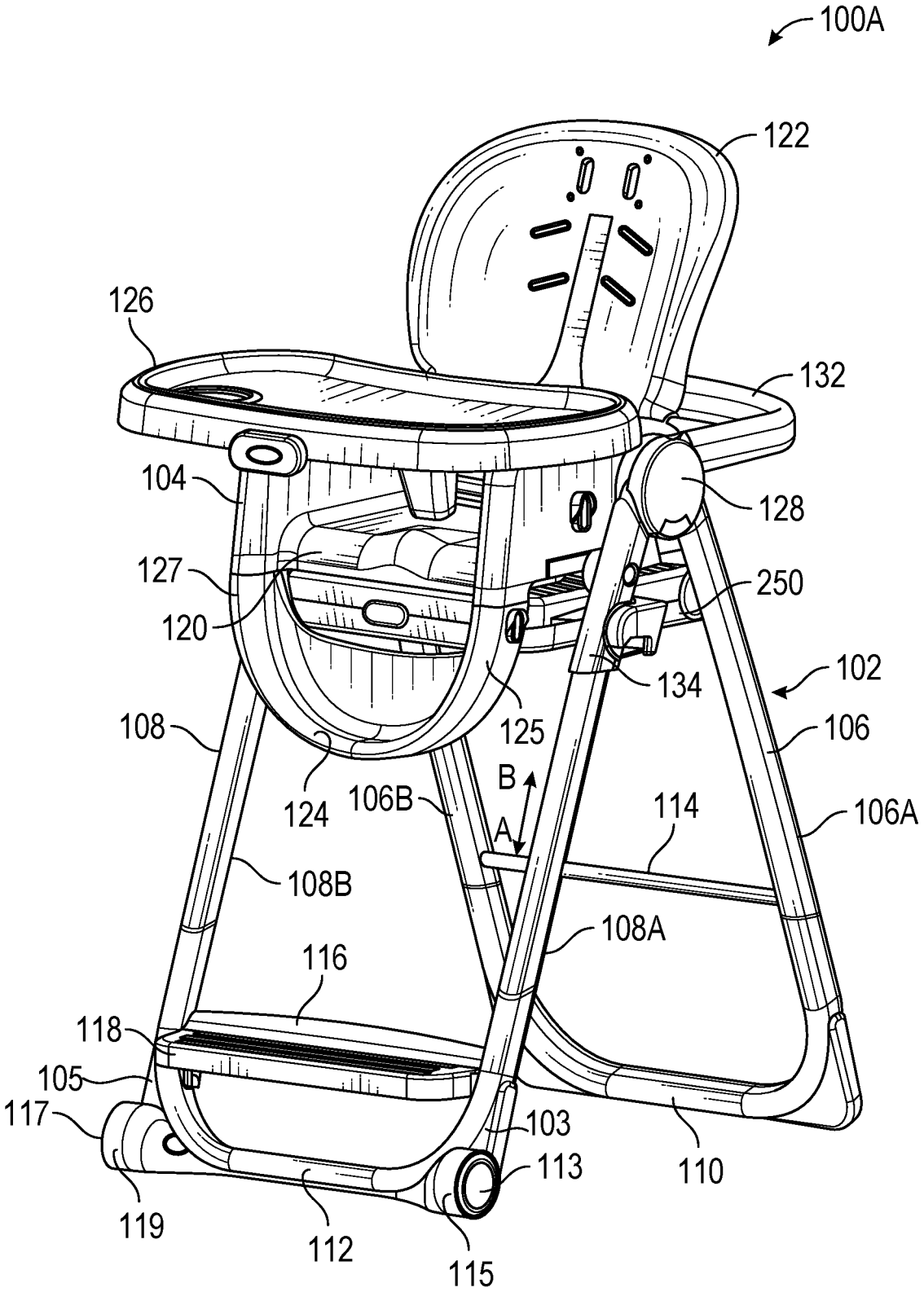
FIG. 1A is a perspective view of a convertible high-chair and step stool in a high-chair configuration in accordance with one example embodiment of the disclosure.
Figure 1B:
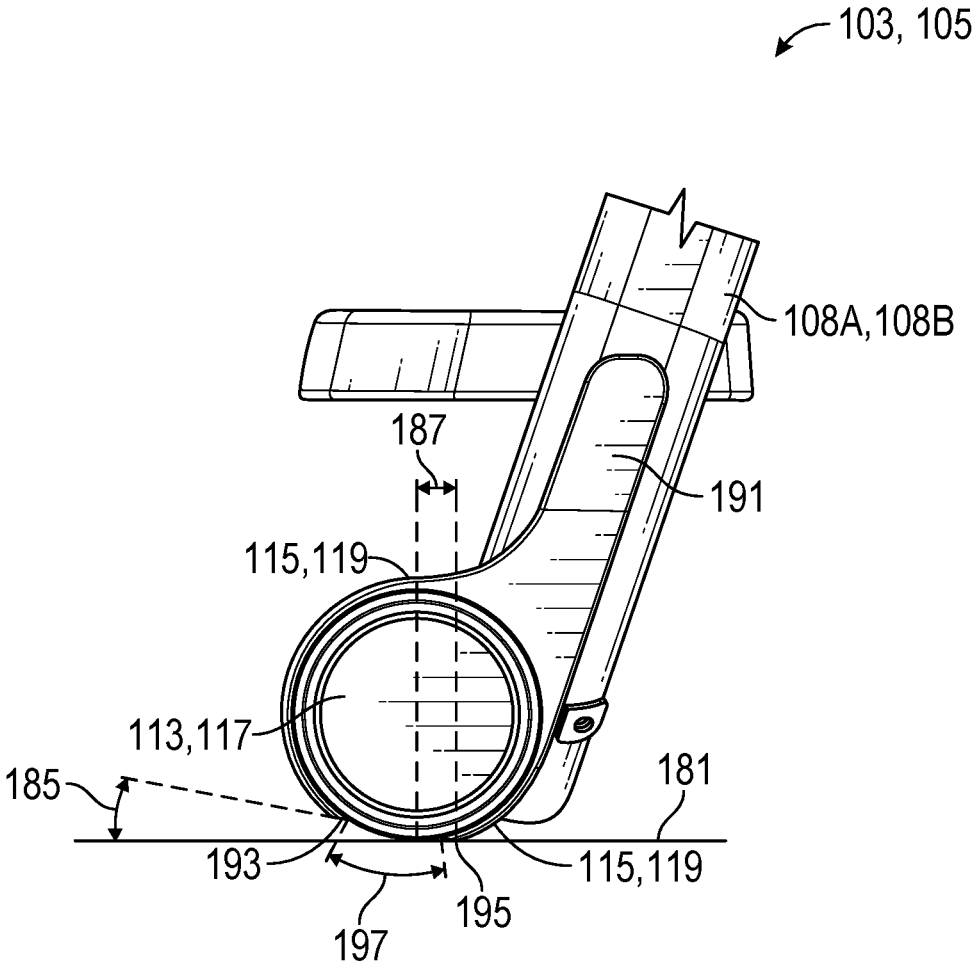
FIG. 1B is a partial-elevation view of a wheel assembly for the convertible high-chair and step stool of FIG. 1A in accordance with one example embodiment of the disclosure.
Figure 1C:
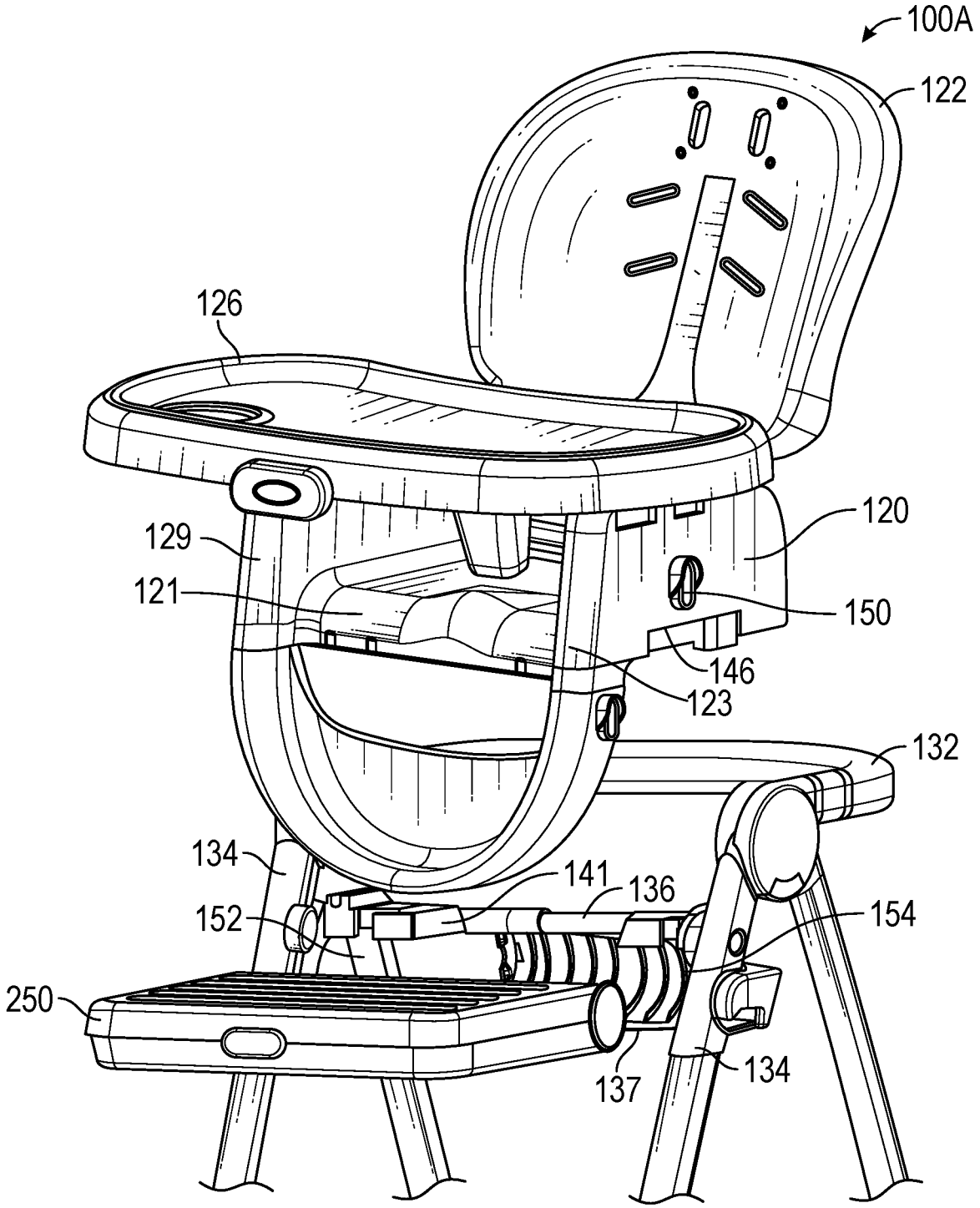
FIG. 1C is partial-perspective view of the convertible high-chair and step stool highlighting the attachment of the booster seat to the foldable stand and the storage of the platform step to the foldable stand in accordance with one example embodiment of the disclosure.
Figure 1D:
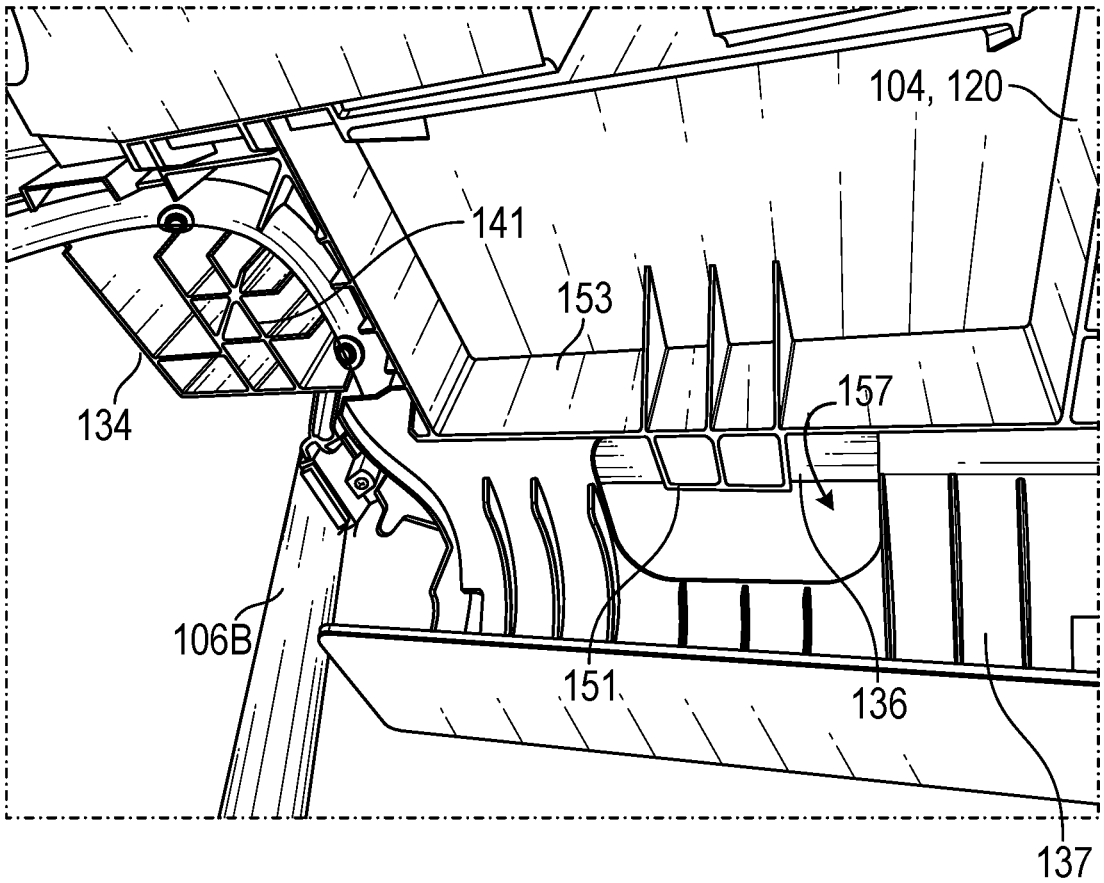
FIG. 1D is a partial-perspective view of a partial connection of the booster seat to the height adjustment mechanism in accordance with one example embodiment of the disclosure.
Figure 1E:
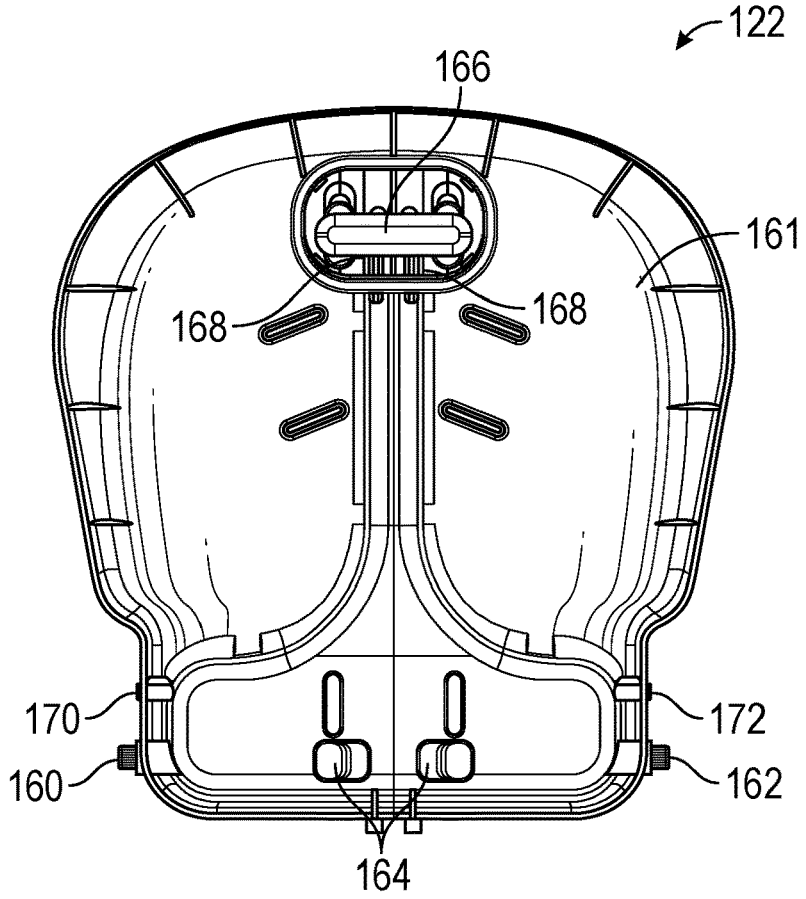
FIG. 1E is a rear elevation view of the removable seat back for the booster seat of the convertible high-chair and step stool of FIG. 1A in accordance with one example embodiment of the disclosure.
Figure 1F:
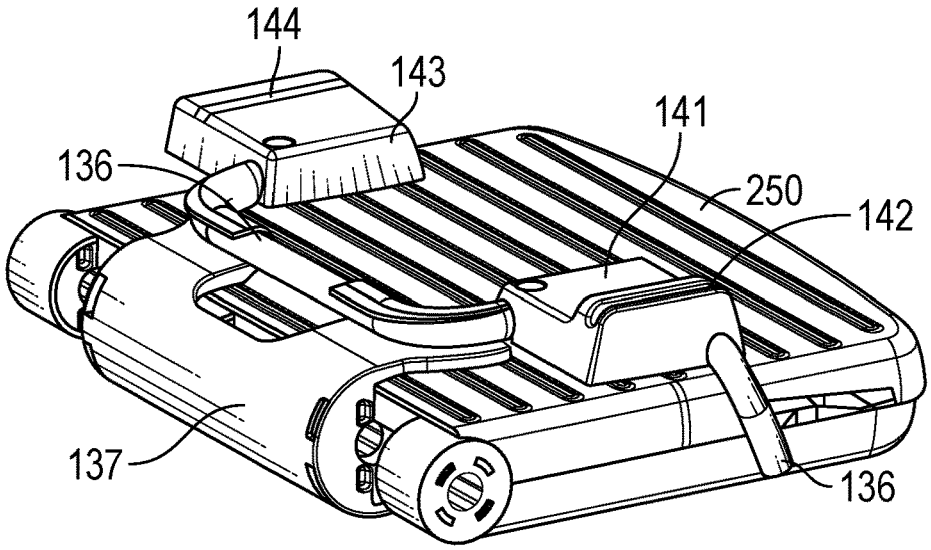
FIG. 1F is a partial-perspective view of the foldable stand and the removable platform step attached to the height adjustment mechanism of the foldable stand of FIG. 1A in accordance with one example embodiment of the disclosure.

FIG. 1A is a perspective view of a convertible high-chair and step stool 100 in the high-chair configuration 100A and constructed in accordance with one example embodiment of the disclosure. FIG. 1B is a partial-elevation view of a wheel assembly for the convertible high-chair and step stool 100 of FIG. 1A in accordance with one example embodiment of the disclosure. FIG. 1C is partial-perspective view of the convertible high-chair and step stool 100 highlighting the attachment of the booster seat 104 to the foldable stand 102 and the storage of the platform step 250 to the foldable stand 102 in accordance with one example embodiment of the disclosure. FIG. 1E is a rear elevation view of the removable seat back 122 for the booster seat 104 of the convertible high-chair and step stool 100 of FIG. 1A in accordance with one example embodiment of the disclosure. FIG. 1F is a partial-perspective view of the foldable stand 102 and the removable platform step 250 attached to the height adjustment mechanism 134 of the foldable stand 102 of FIG. 1A in accordance with one example embodiment of the disclosure. Referring now to FIGS. 1A-1F, the example convertible high-chair and step stool 100A, can include a foldable stand 102 and a booster seat 104 that can be removably coupled and decoupled to the foldable stand 102. In addition, as discussed with reference to FIGS. 2A-2B, the convertible high-chair and step stool 100 can also include one or more platform steps 250 that can be removably coupled and decoupled to the foldable stand 102 to change the use of apparatus from a high-chair to a step stool.

Figure 2A:
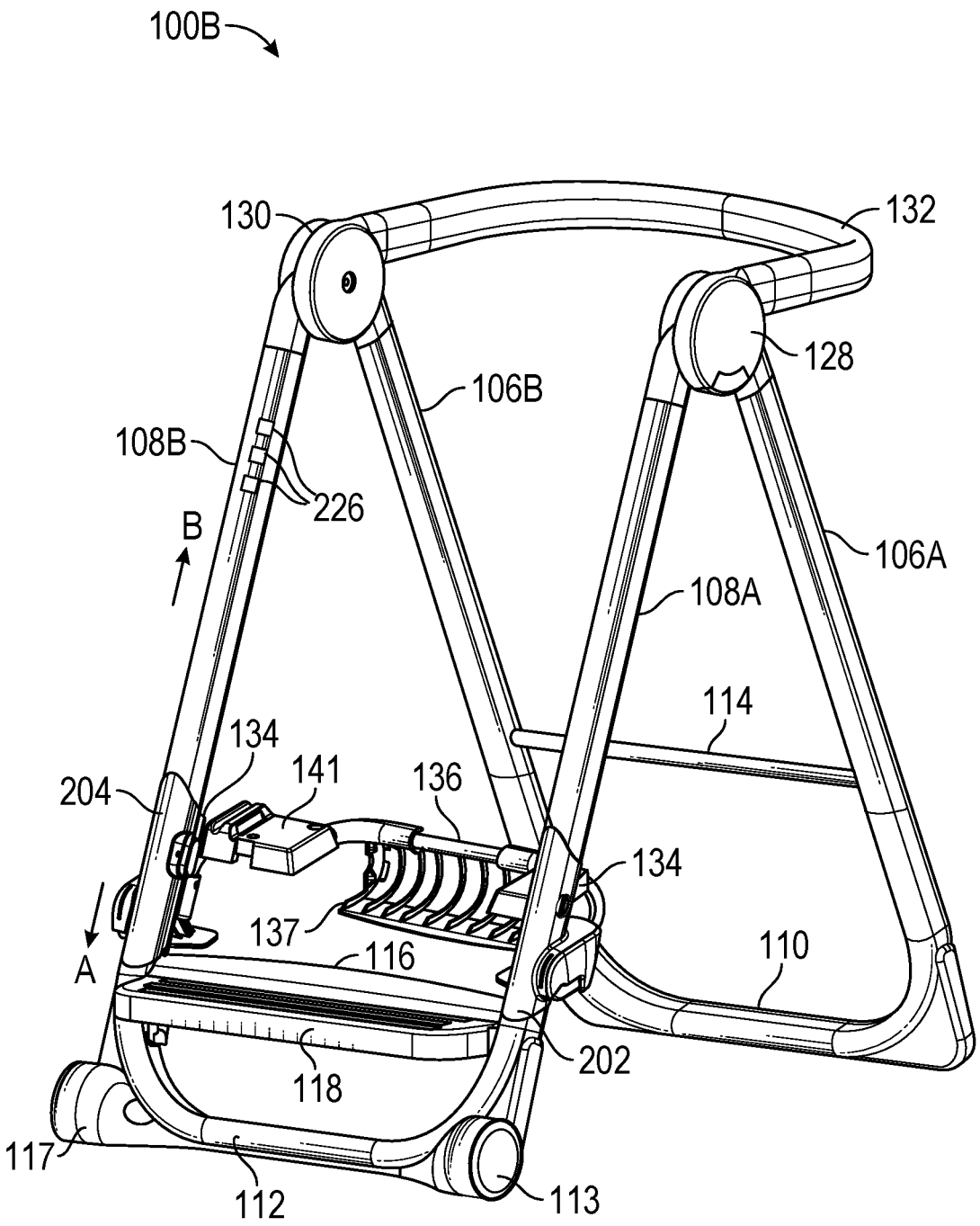
FIGS. 2A and 2B are perspective views of the convertible high-chair and step stool in the step stool configuration with the removable platform step detached and attached in accordance with one example embodiment of the disclosure.

The foldable stand 102 can include a front leg stand 108, a rear leg stand 106, and one or more rotation hubs 128, 130 (see FIG. 2A). In one example the front leg stand 108 is operably coupled to and configured to rotate with respect to the rear leg stand 106 by way of the rotation hubs 128, 130. Each of the front leg stand 108 and the rear leg stand 106 can be constructed of one or more pieces and can be constructed of any material including, but not limited to plastics, polymers, metal, alloys, or any combination thereof. Each of the front leg stand 108 and the rear leg stand 106 can be molded as a single piece or made of multiple pieces that are coupled to one another using known coupling devices, such as screws, rivets, tab-and-slot, press-fit, etc.

The rear leg stand 106 can include a first vertically extending leg 106A, a second vertically extending leg 106B and a base panel 110. A first end of the first leg 106A can be coupled to a first portion of the rotation hub 128 and a distal second end can be coupled to or integrally formed with the base panel 110. The second leg 106B can be coupled to a first portion of the rotation hub 130 and a distal second end can be coupled to or integrally formed with the base panel 110. The base panel 110 can be configured to rest upon a floor surface 181 and can include a bottom surface that is horizontal and includes at least a portion that is flat or substantially flat and configured to rest upon the floor surface 181.

The front leg stand 108 can include a first leg 108A, a second leg 108B, a base panel 112, a first wheel assembly 103, and a second wheel assembly 105. A first end of the first leg 108A can be coupled to a second portion of the rotation hub 128 that is rotatable about a first axis with respect to the first portion of the rotation hub 128. A distal second end of the first leg 108A can be coupled to or integrally formed with the base panel 112. The base panel 112 can be configured to rest upon a floor surface 181 and can include a bottom surface that is horizontal and includes at least a portion that is flat or substantially flat and configured to rest upon the floor surface 181.

In certain example embodiments, one or both of the first leg 108A and the second leg 108B can further include one or more apertures 226 through an outer wall of the respective first leg 108A and/or second leg 108B and into an internal cavity of the respective leg 108A, 108B and/or elongated, inwardly-protruding indentations (not shown) along an outer wall of the respective first leg 108A and/or second leg 108B that does not extend through the respective outer wall. In examples where multiple apertures 226 are provided, those apertures may be positioned along the respective leg 108A, 108B such that they are aligned along at least a portion of the longitudinal axis X of the respective first leg 108A or second leg 108B of the front leg stand 108. In one example, multiple apertures 226 and/or indentations can be provided along the longitudinal axis X of each of the first leg 108A and the second leg 108B. Each aperture 226 and/or indentation 226 can be configured to receive, at least partially therein, a tab end 211 of a seat height adjustment tab 210 (see FIG. 3B) on the height adjustment mechanism 134 to hold the height adjustment mechanism 134, and optionally the booster seat 104, at a particular vertical position with respect to the foldable stand 102. The seat height adjustment tab 210 allows for minor adjustments of the height of the height adjustment mechanism 138, and the booster seat 104 attached thereto, along the front leg stand 108. In certain example embodiments, one or both of the first leg 108A and the second leg 108B can further include one or more second set of apertures and/or indentations (not shown) provided along the longitudinal axis X of each of the first leg 108A and/or the second leg 108B. Each of the second set of apertures and/or indentations can be configured to receive, at least partially therein, a tab end 224 of a spring-biased locking tab 220. In certain examples, each of the first leg 108A and the second leg 108B can include one or more second indentations along the upper part of the respective leg 108A, 108B corresponding to the first set of apertures/indentations 226 that are configured to receive the seat height adjustment tab 210, and at least one aperture positioned along the lower part of the respective first leg 108A and second leg 108B and corresponding to the HAM 134 position for the stepstool configuration 100B. In this example, at least a portion of the tab end 224 of the spring-biased locking tab 220 can be configured to be received in each of the second set of apertures and/or indentations. As such, the spring-biased locking tab 220 can be used to adjust the height of the height adjustment mechanism 134 from a first position for use with the booster seat 104 to a second position, vertically lower than the first position, for use with a platform step 250. In other example embodiments, the functions of the spring-biased locking tab 220 and the seat height adjustment tab 210 may be combined into a single spring-biased locking tab for both adjusting seat height of HAM 134 and booster seat 104 and for moving the HAM from the first position, for attachment to a booster seat 104, to the second position, for attachment to the platform step 250. In other example embodiments, the one or more apertures and/or indentations may instead be provided on the first leg 106A and/or second leg 106B of the rear leg stand 106 for receiving the seat height adjustment tab 211 of the height adjustment mechanism 134 along the rear leg stand 106.

The first wheel assembly 103 can be coupled to one or both of the first leg 108A and the base panel 112. For example, as shown in FIG. 1B, the first wheel assembly can include an attachment member 191. The attachment member 191 can be an elongated shaft that extends into a portion of an internal cavity of the first leg 108A to couple the first wheel assembly 103 to the first leg 108A. The attachment member 191 may be held within the internal cavity of the first leg 108A by friction fit or one or more known coupling devices (e.g., screws, rivets, pins, etc.) may be used to couple the attachment member 191 to a portion of the first leg 108A.

The first wheel assembly 103 can also include a wheel 113 or other rolling device and a fender assembly 115 that surrounds at least a portion of the outer perimeter of the wheel 113. In certain example embodiments, more than one wheel can be provided and the fender assembly 115 can surround at least a portion of the outer perimeter of each wheel 113. In one example, the fender assembly 115 can be integrally formed with the attachment member 191. In other examples, the fender assembly 115 and the attachment member 191 can be separate pieces that are coupled to one-another. In certain example embodiments, the fender assembly 115 can include a foot 195 along a first perimeter end of the fender assembly 115 and an anti-rollaway foot 193 positioned along a distal second perimeter end of the fender assembly 115. The foot 195 can be configured to abut and contact the floor surface 181 when the convertible high-chair and step stool 100 is in the high-chair configuration and the step stool configuration. In one example, the foot 195 is aligned or substantially aligned with the longitudinal axis X of the first leg 108A.

The center of the wheel 113 can be horizontally offset 187 from the longitudinal axis X of the first leg and the foot 195. In one example, the horizontal offset 187 of the center of the wheel 113 from the longitudinal axis of the first leg 108A and the foot 195 is within a range of substantially 5 millimeters (mm) to substantially 40 mm and more preferably within a range of substantially 5 mm to substantially 25 mm and even more preferably within a range of substantially 10 mm to substantially 20 mm. In one example, the horizontal offset 187 is substantially 16 mm. Horizontally offsetting the wheel 113 from the longitudinal axis X of the first leg 108A and the foot 195 can reduce the potential for the convertible high-chair and step stool 100 to tip over backwards (i.e., towards the front leg stand 108) when a child climbs or misuses the convertible high-chair and step stool 100. For example, when a child pulls themselves up onto the first step in the step stool configuration, the pull force could cause the convertible high-chair and step stool 100 to begin to tip backwards. If the wheel 113 is not offset, it could immediately contact the floor surface 181 and increase the rate of tipping and also cause the front leg stand 108 to slide along the floor surface 181. By offsetting the front wheel 113, it moves the tipping point of the foldable stand 102 further back from the front leg stand 108 and further under the child's foot when they are standing on the first step (discussed below).

In addition, to reduce the potential for the wheel 113 to unexpectedly slide along the floor surface 181 when a child tips the foldable stand 102, the anti-rollaway foot 193 is provided along the second end of the fender assembly 115. The open space 197 along the perimeter of the wheel 113 between the foot 195 and the anti-rollaway foot 193 is limited to provide a smaller range of angle or rolling tip angle 185 at which the wheel 113 can contact the floor surface 181 and roll along the floor surface 181. In one example, the rolling tip angle 185 is within the range of substantially 1 degree and substantially 25 degrees and more preferably within the range of substantially 1 degree and substantially 20 degrees and even more preferably within the range of substantially 1 degree and substantially 15 degrees. In one example, the anti-rollaway foot 193 contacts the floor surface 181 when the foldable stand 102 is tilted backwards (i.e. in the direction from the rear leg stand 106 towards the front leg stand 108) substantially 12 degrees away from when the foot 195 contacts the floor surface 181 and the rolling tip angle 185 is within the range of substantially 1 degree to less than 12 degrees. By providing the small rolling tip angle 185 for the wheel 113, the anti-rollaway foot 193 is able to contact the floor surface 181 before the foldable stand 102 is able to over-center itself above the wheel 113 and allow the wheel 113 to uncontrollably slide along the floor surface 181 during a tipping situation by a child.

The second leg 108B can include a first end that is coupled to a second portion of the rotation hub 130 that is rotatable about a second axis with respect t the first portion of the rotation hub 130. In one example, the first axis and the second axis are parallel and in certain example embodiments, coaxially aligned. A distal second end of the second leg 108B can be coupled to or integrally formed with the base panel 112.

The second wheel assembly 105 can be coupled to one or both of the second leg 108B and the base panel 112. For example, as shown in FIG. 1B, the second wheel assembly 105 can include an attachment member 191. The attachment member 191 can be an elongated shaft that extends into a portion of an internal cavity of the second leg 108B to couple the second wheel assembly 105 to the second leg 108B. The attachment member 191 may be held within the internal cavity of the second leg 108B by friction fit or one or more known coupling devices (e.g., screws, rivets, pins, etc.) may be used to couple the attachment member 191 to a portion of the second leg 108B.

The second wheel assembly 105 can also include a wheel 117 or other rolling device and a fender assembly 119 that surrounds at least a portion of the outer perimeter of the wheel 117. In certain example embodiments, more than one wheel can be provided and the fender assembly 119 can surround at least a portion of the outer perimeter of each wheel 117. In one example, the fender assembly 119 can be integrally formed with the attachment member 191. In other examples, the fender assembly 119 and the attachment member 191 can be separate pieces that are coupled to one-another. In certain example embodiments, the fender assembly 119 can include a foot 195 along a first perimeter end of the fender assembly 119 and an anti-rollaway foot 193 positioned along a distal second perimeter end of the fender assembly 119. The foot 195 can be configured to abut and contact the floor surface 181 when the convertible high-chair and step stool 100 is in the high-chair configuration and the step stool configuration. In one example, the foot 195 is aligned or substantially aligned with the longitudinal axis X of the second leg 108B.

The center of the wheel 117 can be horizontally offset 187 from the longitudinal axis X of the second leg 108B and the foot 195. In one example, the horizontal offset 187 of the center of the wheel 117 from the longitudinal axis of the second leg 108B and the foot 195 is within a range of substantially 5 millimeters (mm) to substantially 40 mm and more preferably within a range of substantially 5 mm to substantially 25 mm and even more preferably within a range of substantially 10 mm to substantially 20 mm. In one example, the horizontal offset 187 is substantially 16 mm. Horizontally offsetting the wheel 117 from the longitudinal axis X of the second leg 108B and the foot 195 can reduce the potential for the convertible high-chair and step stool 100 to tip over backwards (i.e., in a direction from the rear leg stand 106 towards the front leg stand 108) when a child climbs or misuses the convertible high-chair and step stool 100. For example, when a child pulls themselves up onto the fixed platform step 118 in the step stool configuration, the pull force could cause the convertible high-chair and step stool 100 to begin to tip backwards. If the wheel 117 is not offset, it could immediately contact the floor surface 181 and increase the rate of tipping and also cause the front leg stand 108 to slide along the floor surface 181. By offsetting the front wheel 117, it moves the tipping point of the foldable stand 102 further back from the front leg stand 108 and further under the child's foot when they are standing on the fixed platform step 118 (discussed below).

In addition, to reduce the potential for the wheel 117 to unexpectedly slide along the floor surface 181 when a child tips the foldable stand 102, the anti-rollaway foot 193 is provided along the second end of the fender assembly 119. The open space 197 in the fender assembly 119 along the perimeter of the wheel 117 between the foot 195 and the anti-rollaway foot 193 is limited to provide a smaller range of angle or rolling tip angle 185 at which the wheel 117 can contact the floor surface 181 and roll along the floor surface 181. In one example, the rolling tip angle 185 is within the range of substantially 1 degree and substantially 25 degrees and more preferably within the range of substantially 1 degree and substantially 20 degrees and even more preferably within the range of substantially 1 degree and substantially 15 degrees. In one example, the anti-rollaway foot 193 contacts the floor surface 181 when the foldable stand 102 is tilted backwards (i.e., in the direction from the rear leg stand 106 towards the front leg stand 108) substantially 12 degrees away from when the foot 195 contacts the floor surface 181 and the rolling tip angle 185 is within the range of substantially 1 degree to less than 12 degrees. By providing the small rolling tip angle 185 for the wheel 117, the anti-rollaway foot 193 is able to contact the floor surface 181 before the foldable stand 102 is able to over-center itself above the wheel 113 and allow the wheel 113 to uncontrollably slide along the floor surface 181 during a tipping situation by a child.

The first portion of the rotation hub 128 can rotate with respect to the second portion of the rotation hub 128 about the first axis such that the first leg 106A of the rear leg stand 106 can rotate with respect to the first leg 108A of the front leg stand 108 or vice-versa. Further, the first portion of the rotation hub 130 can rotate with respect to the second portion of the rotation hub 130 about the second axis such that the second leg 106B of the rear leg stand 106 can rotate with respect to the second leg 108B of the front leg stand 108 or vice-versa.

The foldable stand 102 can also include a rear crossbeam support member 114. In one example, the rear crossbeam support member 114 can be an elongated member or shaft having a first end coupled to the first leg 106A and a distal second end coupled to the second leg 106B of the rear leg stand 106. The rear crossbeam support member 114 can be solid or hollow and can have any cross-sectional shape, including, but not limited to, planar, circular, oval, or rectangular. The example rear crossbeam support member 114 can be positioned along the rear leg stand 106 between the base panel 110 and the rotation hubs 128, 130. The rear crossbeam support member 114 can provide additional support for the rear leg stand 106 as well as be a support for at least a portion of the platform step 250 discussed below.

The foldable stand 102 can also include a front crossbeam support member 116. In one example, the front crossbeam support member 116 can have a first end coupled to the first leg 108A and a distal second end coupled to the second leg 108B of the front leg stand 108. The front crossbeam support member 116 can be solid or hollow and can have any cross-sectional shape, including, but not limited to, planar, circular, oval, or rectangular. The example front crossbeam support member 116 can be positioned along the front leg stand 108 between the base panel 112 and the rotation hubs 128, 130. The front crossbeam support member 116 can provide additional support for the front leg stand 108.

The foldable stand 102 can also include a fixed platform step 118 extending between the first leg 108A and the second leg 108B. In one example embodiment, the fixed platform step 118 can be fixedly coupled to the foldable stand 102. For example, the fixed platform step 118 can be fixedly coupled to the front crossbeam support member 116 and/or the first leg 108A and the second leg 108B. The fixed platform step 118 can include generally horizontal and/or flat top surface and can have a width (defined as the distance between the first leg 108A and the second leg 108B) that is greater than its depth. The fixed platform step 118 can be configured to be stepped on by a person, such as a child. The fixed platform step 118 can also include means for increasing friction along the top surface of the step 118. These friction increasing means can include, but are not limited to, raised studs, raised strips, friction tape, a friction increasing coating or material disposed along the top surface of the step 118, and/or indentations or channels carved into the top surface of the step 118.

The foldable stand 102 can also include a support member 132 extending from the first rotation hub 128 to the second rotation hub 130. In one example, the support member 132 is generally U-shaped and extends from a top end of the first leg 106A to the top end of the second leg 106B. The support member 132 can provide additional stabilizing support for the left and right sides of the foldable stand 102.

Figure 3A:
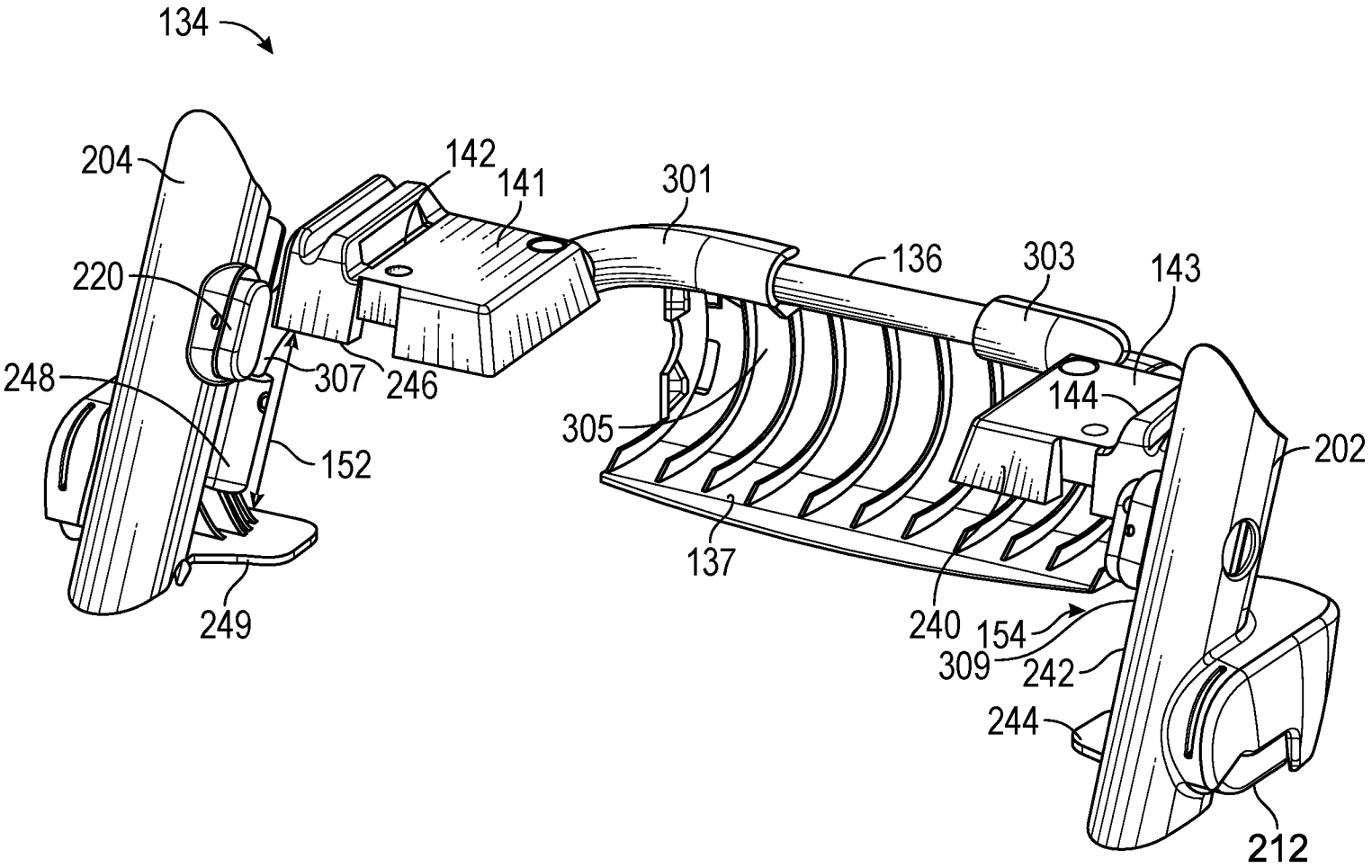
FIG. 3A is a perspective view of the height adjustment mechanism for the convertible high-chair and step stool of FIG. 1A in accordance with one example embodiment of the disclosure.
Figure 3B:
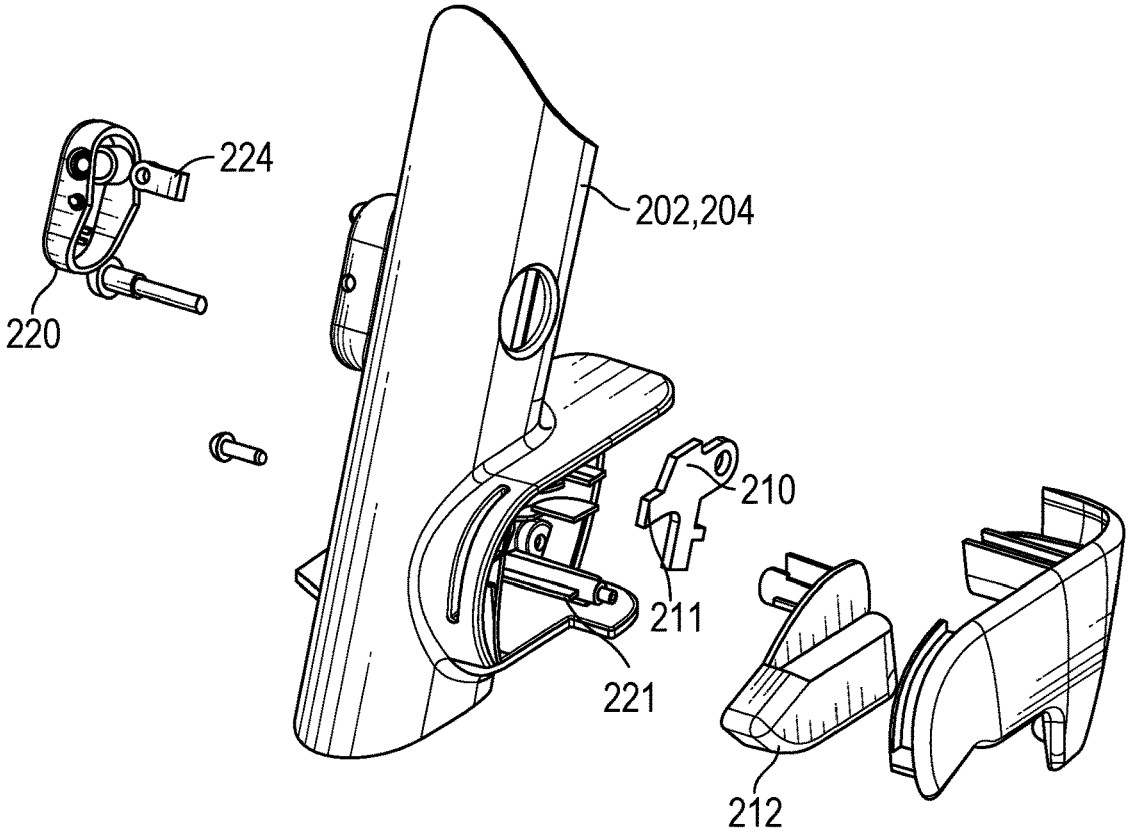
FIG. 3B is a partial exploded view of the locking mechanisms for the height adjustment mechanism of FIG. 3A in accordance with one example embodiment of the disclosure.
Figure 3C:
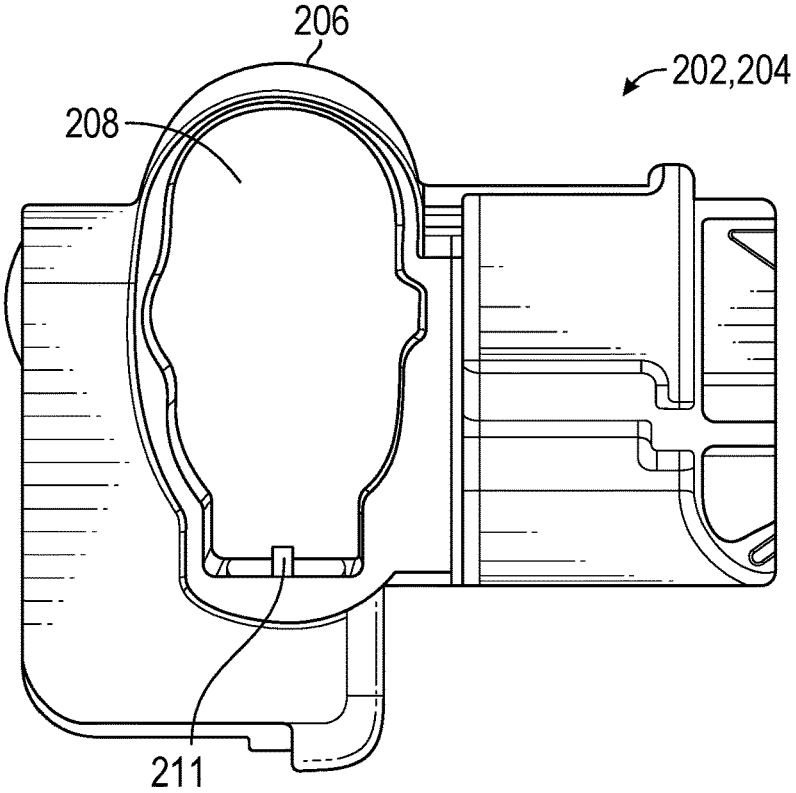
FIG. 3C is a partial plan view of the height adjustment mechanism housing of FIG. 3A in accordance with one example embodiment of the disclosure.

The foldable stand 102 can also include a height adjustment module (HAM) 134. The HAM 134 can be slidably adjustable in the directions A and B along the longitudinal axis X of the first leg 108A and the second leg 108B of the front leg stand 108. Alternatively, the HAM can be slidably adjustable in the directions A and B along the longitudinal axis X of the first leg 106A and the second leg 106B of the rear leg stand 106. As shown in FIGS. 3A-3C, the HAM 134 can include a first HAM housing 202 and a second HAM housing 204. The HAM 134 can also include a HAM crossbeam support member 136 that extends between the first HAM housing 202 and the second HAM housing 204. For example, the HAM crossbeam support member 136 can have a first end 309 coupled to the first HAM housing 202 and a distal second end 307 coupled to the second HAM housing 204. The HAM crossbeam support member 136 can be solid or hollow and can have any shape cross-section including, but not limited to, planar, circular, oval, or rectangular. In certain example embodiments, the HAM crossbeam support member is a tubular member with a circular or substantially circular cross-section. In an alternative embodiment, the HAM crossbeam support member 136 could extend between and be fixedly coupled to the first leg 108A and the second leg 108 rather than being part of the HAM 134. In this alternative embodiment, the HAM crossbeam support member 136 would be positioned at a vertical position above that of the front crossbeam support member 136.

The first HAM housing 202 can include a first seat attachment housing 143. In one example, the first seat attachment housing 143 can be coupled to the HAM crossbeam support member 136. In other example embodiments, the first seat attachment housing 143 can be coupled to another portion of the HAM 134, such as the first HAM housing 202. The first seat attachment housing 143 can include a first receiving slot 144 disposed along a top surface of the first seat attachment housing 143 and configured to receive a first tab or bayonet 146 on the booster seat 104. In one example, the first receiving slot is an aperture that provides a cavity that extends into the first seat attachment housing 143 and that is sized and shaped to receive the first tab or bayonet 146 on the booster seat 104 to removably couple the booster seat 104 to the HAM 134 and effectively to the foldable stand 102.

The first HAM housing 202 can also include a generally horizontally extending top wall 240, a generally vertically extending side wall 242, and a generally horizontally extending bottom wall 244 that define a channel 154, slot, or cavity for receiving a portion of the removable platform step 250 when stored under the booster seat 104, as described in greater detail below. In one example, at least a portion of the bottom surface of the first seat attachment housing 143 defines all or at least a portion of the generally horizontally extending top wall 240.

The second HAM housing 204 can include a second seat attachment housing 141. In one example, the second seat attachment housing 141 can be coupled to the HAM crossbeam support member 136. In other example embodiments, the second seat attachment housing 141 can be coupled to another portion of the HAM 134, such as the second HAM housing 202. The second seat attachment housing 141 can include a second receiving slot 142 disposed along a top surface of the second seat attachment housing 141 and configured to receive a second tab or bayonet (not shown) on the booster seat 104. In one example, the second receiving slot 142 is an aperture that provides a cavity that extends into the second seat attachment housing 141 and that is sized and shaped to receive the second tab or bayonet (not shown) to removably couple the booster seat 104 to the HAM 134 and effectively to the foldable stand 102.

The second HAM housing 204 can also include a generally horizontally extending top wall 246, a generally vertically extending side wall 248, and a generally horizontally extending bottom wall 249 that define a channel 152, slot, or cavity for receiving another portion of the removable platform step 250. In one example, at least a portion of the bottom surface of the second seat attachment housing 141 defines all or at least a portion of the generally horizontally extending top wall 240.

The HAM 134 can also include a storage backstop 137 for receiving yet another portion of the removable platform step 250 when it is stored with the HAM 134. In one example, the storage backstop 137 is coupled to the HAM crossbeam support member 136. For example, the storage backstop 137 can include a one or more attachment arms 301, 303 that can be fixedly or removably coupled to the HAM crossbeam support member 136. In one example, each attachment arm 301, 303 can have an inner wall provided in a shape that substantially corresponds with at least a portion of the outer surface of the HAM crossbeam support member 136. For example, the HAM crossbeam support member 136 can have a round outer surface and the inner surface of each of the one or more attachment arms can be curved to generally coincide with the radius of the outer surface of the HAM crossbeam support member 136. However, in other examples, the outer surface of the HAM crossbeam support member 136 and the inner surface of each arm 301, 303 can be of different shapes and merely coupled to one another. The storage backstop 137 can include a step receiving surface 305 positioned along a front side of the storage backstop 137. The step receiving surface 305 can be curved and/or have a generally concave shape for receiving a portion of the removable platform step 250 therein or thereon. In one example embodiment, the storage backstop 137 is positioned along the HAM crossbeam support member 136 between the first seat attachment housing 143 and the second seat attachment housing 141. In one example, the generally horizontally extending top wall 240, generally vertically extending side wall 242, and generally horizontally extending bottom wall 244 that define the channel 154, slot, or cavity, the generally horizontally extending top wall 246, the generally vertically extending side wall 248, and the generally horizontally extending bottom wall 249 that define the channel 152, slot, or cavity, along with the storage backstop 137 define a storage area within which the removable platform step 250 may be inserted, such as slidably inserted, in the folded or unfolded configuration when the seat 100 is being used as a high-chair rather than a step stool. Providing a storage area for the removable platform step 250 when not in use reduces the likelihood that the step 250 may be lost or damaged when not being used.

As shown in FIG. 1C, the removable platform step 250 can be placed in a folded configuration and slidably inserted under the bottom side of the booster seat base 120. A first portion of the removable platform step 250 can extend into the channel 152 along a first lateral side of the step 250 and a second portion of the removable platform step 250 can extend into the channel 154 along an opposing second lateral side of the step 250. The step 250 can be slidably inserted into the channels 152, 154 in a direction from the front leg stand 108 towards the rear leg stand 106. As the step 250 is being slidably inserted, the leading end of the step 250 can contact the step receiving surface 305 of the storage backstop 137. The storage backstop 137 can them prevent further insertion of the step 250 in the insertion direction. The bottom walls 244, 249 and at least a portion of the step receiving surface 305 can provide vertical support to the removable platform step 250 while stored with the HAM 134 under the booster seat 104.

Each HAM housing 202, 204, can include one or more cavity walls 206 that have an inner surface that defines a leg sleeve cavity 208 configured to surround one of the legs of the foldable stand 102. In one example an inner surface of a single unitary cavity wall 206 defines the leg sleeve cavity 208. In other examples, the inner surface of multiple walls 206 may be joined to create the shape that defines the leg sleeve cavity 208.

Each HAM housing 202, 204 can also include a spring-biased locking tab 220. In one example, the spring-biased locking tab 220 can include a tab end 224 that is configured to be inserted into the one or more apertures and/or indentations provided along the outer wall of the first leg 106A or 108A and/or the second leg 106B or 108B to set the vertical position of the HAM 134 along the foldable stand 102 from a booster seat attachment position (as shown in FIG. 1C) to a platform step attachment position (as shown in FIG. 2A) which is vertically below the booster seat attachment position. The spring-biased locking tab 220 can be positioned within the respective HAM housing 202, 204 and can move (e.g., rotate) from a spring-biased first position, where the tab end 224 of the locking tab 220 is inserted into an aperture or indentation along one of the legs of the foldable stand 102 and prevents the HAM 134 from moving with respect to the foldable stand 102 to a second position where the tab end 224 of the locking tab 220 is removed from the aperture or indentation in one of the legs of the foldable stand 102 and allows the HAM 134 to be adjusted vertically along the foldable stand 102 along the longitudinal axis X of the respective legs 108A, 108B (or 106A, 106B) from the booster seat attachment position to the platform step attachment position and vice-versa.

At least a portion of the outer surface of the spring-biased locking tab 220 can function as a release lever for moving the tab end 224 of the locking tab 220 from the spring-biased first position to the second position in certain example embodiments. In other embodiments, a release lever can be operably coupled to the spring-biased locking tab 220 and/or tab end 224. The release lever of the locking tab 220 can be manually adjustable from a first position to a second position to move the locking tab 220 and tab end 224 from its spring-biased first position to its second position to allow the HAM 134 to be slidably adjusted along the legs to adjust the height position of the HAM 134 along the foldable stand 102. In one example, the release lever of the locking tab 220 is rotatable from its first position to its second position. In other examples, the release lever of the locking tab 220 can be alternatively slidable, depressable or have any other similar movement to cause a corresponding movement in the locking tab 220 and/or tab end 224.

The tab end 224 of the spring-biased locking tab 220 can be spring-biased into a first position by a spring-biasing member (not shown) that contacts one or both of the tab end 224 and the spring biased locking tab 220. The spring-biasing member can be a compression spring, torsion spring, another type of spring or any other biasing means known to those of ordinary skill in the art. When the tab end 224 is inserted into the opening or indentation, the spring biased locking tab 220 prevents the HAM 134 from sliding along the longitudinal axis X of one of the front leg stand 108 or the rear leg stand 106 and being adjusted from the booster seat attachment position to the platform step attachment position and vice-versa. As such, the spring-biased locking tab 220 can be used to adjust the height of the HAM 134 from a first position for use with the booster seat 104 to a second position, vertically lower than the first position, for use with a platform step 250.

In certain example embodiments, at least one of the HAM housings 202, 204 can also include a seat height adjustment tab 210 operably coupled to a seat height adjustment lever 212. The seat height adjustment tab 210 can be spring-biased into a first position by a spring-biasing member 221 that contacts one or both of the seat height adjustment tab 210 and the seat height adjustment lever 212. The spring-biasing member 221 can be a compression spring, torsion spring, another type of spring or any other biasing means known to those of ordinary skill in the art. The seat height adjustment tab 210 can include a tab end 211 and can be adjustable from the first position, in which at least a portion of the tab end 211 extends into an aperture 226 or indentation (not shown) of the corresponding leg 108A, 108B (or 106A, 106B) to a second position, where the tab end 211 of the seat height adjustment tab 210 is withdrawn from the opening 226 or indentation. When inserted into the opening 226 or indentation, the tab end 211 provides additional coupling of the HAM 134 to the foldable stand 102 to prevent the HAM 134 from sliding along the longitudinal axis X of one of the front leg stand 108 or the rear leg stand 106.

The seat height adjustment lever 212 can be operably coupled to the seat height adjustment tab 210. The seat height adjustment lever 212 can be manually adjustable from a first position to a second position to move the seat height adjustment tab 210 and tab end 211 from its spring-biased first position to its second position. In one example, the seat height adjustment lever 212 is rotatable from its first position to its second position. In other examples, the seat height adjustment lever 212 can be alternatively slidable, depressable, or have any other similar movement to cause a corresponding movement in the seat height adjustment tab 210. The seat height adjustment tab 210 allows for minor adjustments of the height of the height adjustment mechanism 138, and the booster seat 104 attached thereto, along the front leg stand 108. In other example embodiments, the functions of the spring-biased locking tab 220 and the seat height adjustment tab 210 may be combined into a single spring-biased locking tab for both adjusting seat height of HAM 134 and booster seat 104 and for moving the HAM from the first position, for attachment to a booster seat 104, to the second position, for attachment to the platform step 250.

Returning to FIGS. 1A-D, the booster seat 104 can include a booster seat base 120, a seat back 122, a foot rest 124, and a removable tray 126. In one example, the booster seat base 120 can include a seat bottom 121 configured to have a child sit thereon, a first side panel 123 extending up from the seat bottom 121 in a vertical or substantially vertical direction along a first lateral side of the booster seat base 120, and a second side panel 129 extending up from the seat bottom 121 in a vertical or substantially vertical direction along a second lateral side opposite the first lateral side of the booster seat base 120. The top end of each of the first side panel 123 and second side panel 129 can further include or define arm rests. In one example embodiment, the removable tray 126 can be removably coupled to and decoupled from the booster seat base 120 along each of the first side panel 123 and second side panel 129. The booster seat base 120 may be constructed of plastic or metal and may be molded or made from multiple parts and materials can coupled together.

Along the rear side of the booster seat base 120, it can also include one or more apertures (not shown) extending through at least a portion of the booster seat base 120 for routing webbing (e.g., straps, belts, etc.) therethrough. The webbing can be part of a child restraint system to hold the child in the high-chair or coupled to soft goods (e.g., fabric, leather, pleather, padding, or the like) that can be applied to at least a portion of the booster seat base 120 to improve the comfort of the booster seat base 120.

The booster seat base 120 can also include at least one tab or bayonet 146. In one example, a pair of tabs or bayonets 146 can extend from the booster seat base 120 and can be positioned along opposing lateral sides of the booster seat base 120. In one example, each tab or bayonet 146 can be a member extending generally vertically downward from the booster seat base 120 and can be sized and shaped to be received in a respective one of the first receiving slot 144 and the second receiving slot 142 to removably couple the booster seat base 104 to the HAM 134 and operably couple it to the foldable stand 102, as shown in FIGS. 1A-1B. The booster seat base 120 can also include one or more booster seat release buttons 150. For example, a pair of booster seat release buttons 150 can be provided along opposing lateral sides of the booster seat base 120. Each booster seat release button 150 can be operably coupled to a member that engages the respective tab or bayonet 146 and applies a force thereon to allow the tab or bayonet 146 to be removed from the respective first receiving slot 144 and second receiving slot 142, thereby allowing the booster seat base 120 to be decoupled from the HAM 134 and the foldable stand 102.

In certain example embodiments, the booster seat base 120 of the booster seat 104 can also include an additional coupling device 151 for coupling the booster seat 104 to the height adjustment mechanism 134. In one example, the coupling device 151 can be coupled to a back side 153 of the booster seat base 120 and can extend out therefrom. For example, the coupling device 151 can be integrally formed with the booster seat base 120 or separately formed and attached to the booster seat base 120. The coupling device 151 can be configured to engage the HAM crossbeam support member 136 when coupling the booster seat 104 to the height adjustment mechanism 134. For example, the coupling device 151 may be positioned under and/or around at least a portion of the HAM crossbeam support member 136 within an opening 157 in the storage backstop 137. A front side of the booster seat base 120 may then be lowered so that each tab or bayonet 146 can be received in a respective one of the first receiving slot 144 and the second receiving slot 142 to removably couple the booster seat base 104 to the HAM 134. In certain example embodiments, the coupling device 151 can have and substantially L-shape or hook shape (such as a J-hook or curved shape). In other examples, the coupling device 151 can be a planar member extending out along a horizontal or substantially horizontal plane from the back side 153 of the booster seat base 120, such that the back wall 153 of the booster seat base 120 acts as the vertical portion of an L-shaped member. In other examples, the coupling device 151 can be eliminated altogether and/or be optional.

In addition or in the alternative, the rather than the booster seat 104 having tabs or bayonets, and the height adjustment mechanism having the first receiving slot 144 and the second receiving slot 142, the booster seat can have a HAM coupling device (not shown) that removably couples the booster seat 104 directly to the HAM crossbeam support member 136. In this example, a HAM coupling device can be positioned along the bottom of the booster seat base 120 and/or along each lateral side of the booster seat base 120. The HAM coupling device can be a spring-biased catch or other device for capturing all or a portion of the HAM crossbeam support member 136 to hold the booster seat 104 in place with respect to the HAM 134.

In certain example embodiments, the seat back 122 can be removable from and removably coupled to the booster seat base 120. In other example embodiments, the seat back 122 can be fixedly coupled to the booster seat base 120. Providing a removable seat back 122 allows the user to choose to use the booster seat base 120 alone as a booster seat on a seat surface when not attached to the foldable stand 102 or along with the seat back 122 either attached or detached from the foldable stand 102. As shown in FIG. 1E, the removable seat back 122 can include attachment tabs 160, 162 that can be positioned, for example, along opposing lateral sides of the bottom of the seat back 122. In one example, the attachment tabs 160, 162 can be horizontally adjustable with respect to the seat back 122. One or more seat back release levers 164 can be positioned along the back side 161 of the seat back 122 and operably coupled to one or both of the attachment tabs 160, 162. For example, a separate seat back release lever 164 can be coupled to each of the attachment tabs 160, 162 via one or more wires. In one example, a pair of seat back release levers 164 and two attachment tabs 160, 162 are shown, but this is for example purposes only as one or more than two seat back release levers 164 may be provided.

In certain example embodiments, the seat back 122 can also be reclinable (rotatable) with respect to the booster seat base 120. In this example, the seat back 122 can further include a seat back recline lever 166 and one or more wires 168 coupled to the seat back recline lever 166. The distal end of each wire 168 can be coupled to the seat recline pegs 170, 172 to allow for minor adjustments that allow the seat back 122 to rotate with respect to the booster seat base 120.

In certain example embodiments, the foot rest 124 can be removably coupled to and decoupled from the booster seat base 120. In other example embodiments, the foot rest 124 is fixedly coupled to the booster seat base 120. Providing a removable foot rest 124 allows the user greater flexibility to use the booster seat base 120 alone, either attached to or detached from the foldable stand 102. In one example, the foot rest 124 can include a first attachment arm 125 extending from a top end of the foot rest 124 along a first lateral side and a second attachment arm 127 extending from the top end of the foot rest 124 along a second lateral side opposite the first lateral side. Each attachment arm 125, 127 can include a tab or bayonet that can be slidably inserted into an opening along a bottom side of the booster seat base 120 to removably couple the foot rest 124 to the booster seat base 120. Each tab or bayonet can be spring-biased by a spring or other biasing means to engage or couple to the booster seat base 120. In one example, the foot rest 124 can also include a tab release button for each of the tabs or bayonets and operably coupled thereto. The tab release buttons may be manually adjusted from a first position to a second position to release each respective tab or bayonet of the foot rest 124 from the respective opening on the bottom side of the booster seat base 120. In other example embodiments, each tab or bayonet may be coupled to the booster seat base 120 via a press-fit into each of the respective openings along the bottom side of the booster seat base 120. In another alternative embodiment, the booster seat base 120 can include the tabs or bayonets and the foot rest 124 can include the openings for receiving those tabs or bayonets along each attachment arm 125, 127.

Figure 2B:
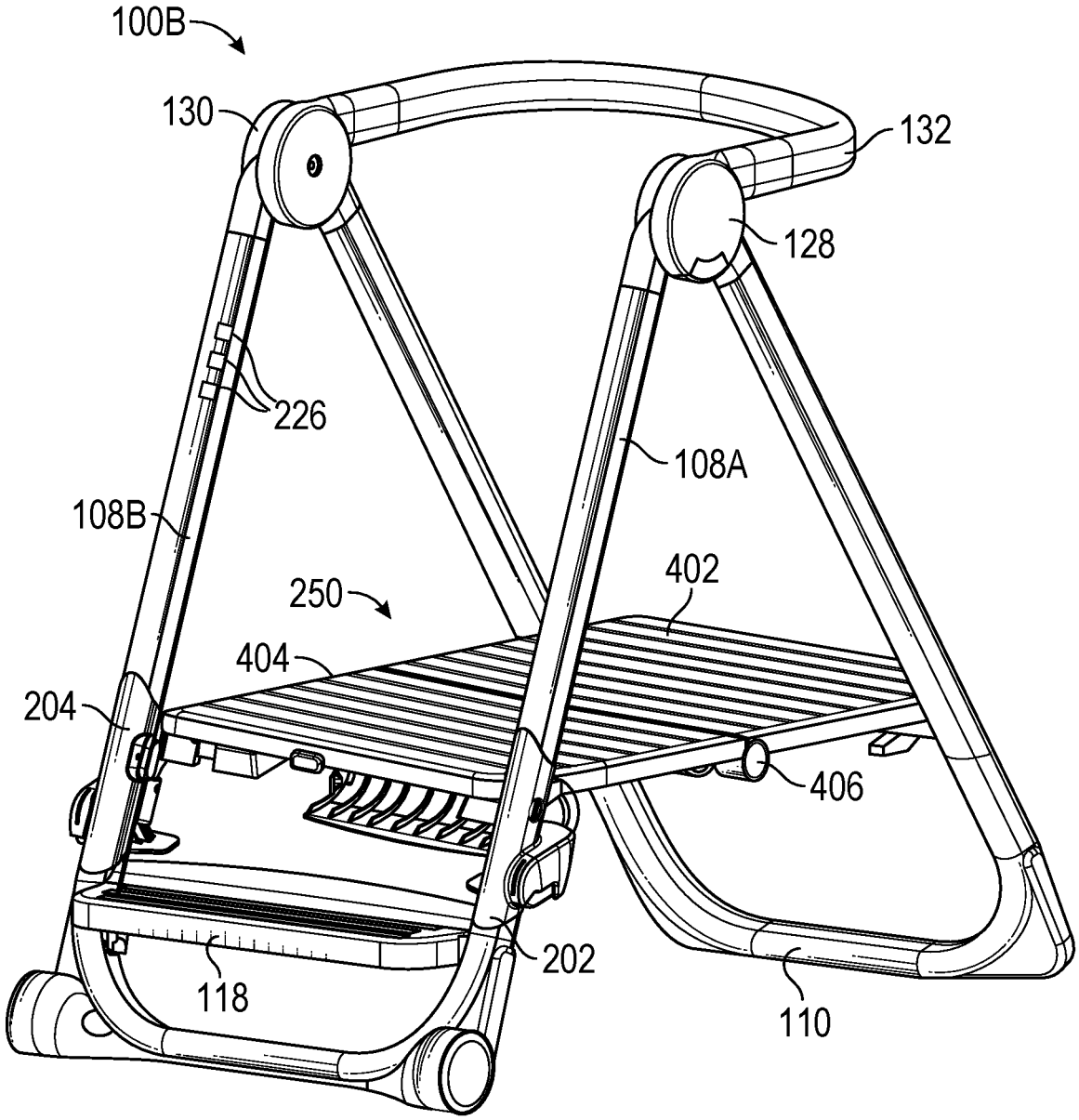

FIGS. 2A and 2B are perspective views of the convertible high-chair and step stool 100 in the step stool configuration 100B in accordance with one example embodiment of the disclosure. Referring now to FIGS. 2A-2B, the booster seat 104 has been decoupled from the HAM 134. The HAM 134 has been slidably adjusted in the direction A along the longitudinal axis of the first leg 108A and the second leg 108B towards the base panel 112. Moving the HAM 134 can be accomplished by a user manually applying a force to the release lever of the spring-biased locking tab 220 on each HAM housing 202, 204 to disengage the tab ends 224 of the corresponding spring-biased locking tabs 220 from the corresponding apertures or indentations in the legs 108A, 108B, and then applying a generally downward force on the HAM 134 to slide it along the longitudinal axes X of the legs 108A, 108B. In one example, the HAM 134 is slidably adjusted in the direction A until at least one of the first HAM housing 202 and the second HAM housing 204 contacts the front crossbeam support member 116 and/or the fixed platform step 118. In other example embodiments, the HAM 134 is slidably adjusted in the direction A until the tab end 224 of each spring-biased locking tab 220 is positioned to enter a corresponding aperture or indentation along the legs 108A, 108B.

Figure 4:
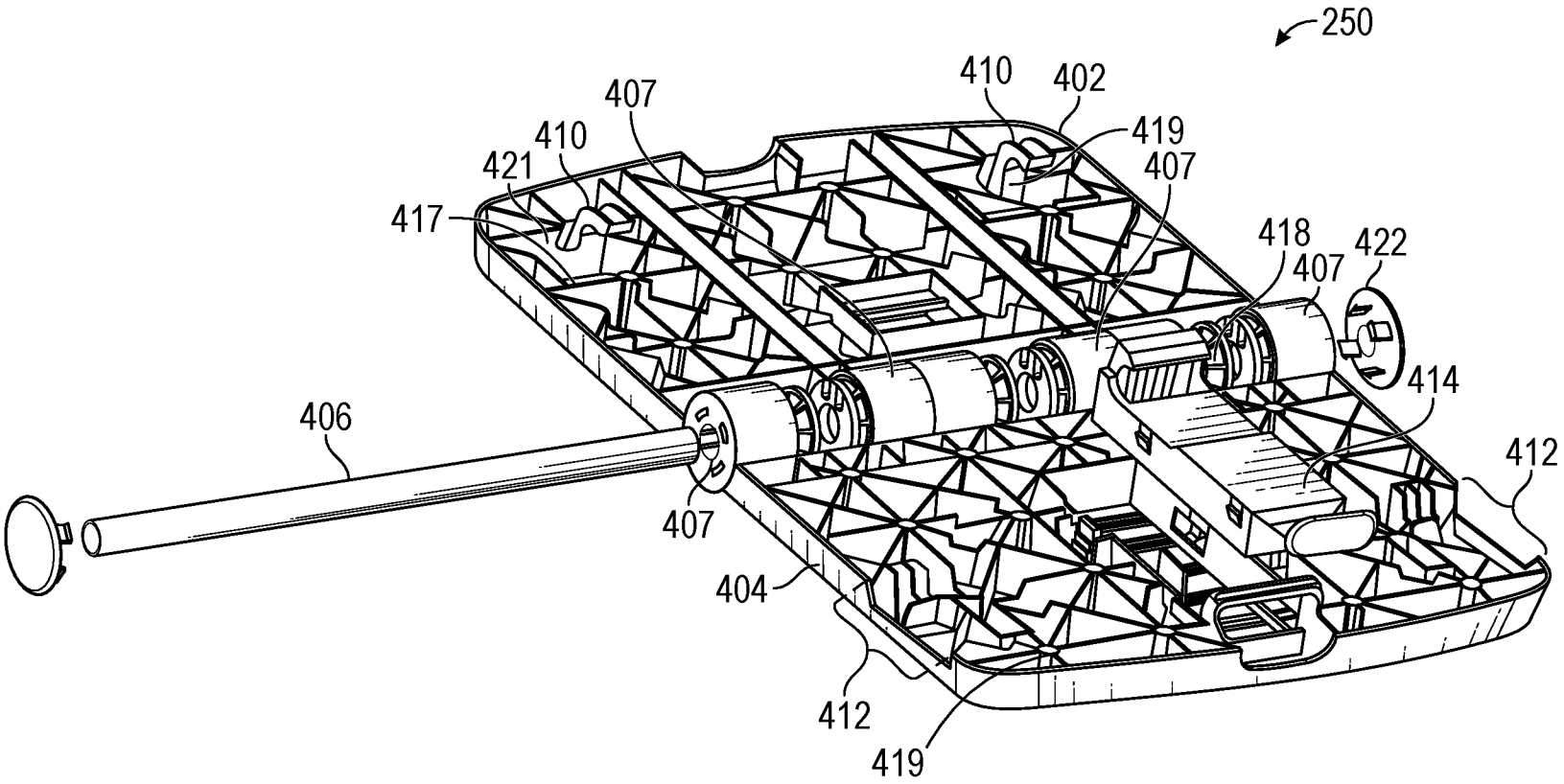
FIG. 4 is a partial exploded view of the removable platform step for the convertible high-chair and step stool of FIG. 1A in accordance with one example embodiment of the disclosure.

Once the HAM 134 has reached its lowered position, the removable platform step 250 can be attached to the foldable stand 102. FIG. 4 is a partial exploded view of the removable platform step for the convertible high-chair and step stool of FIG. 1A in accordance with one example embodiment of the disclosure. Now referring to FIGS. 1A-4, one example of the platform step 250 can include a first step panel 402 and a second step panel 404. In one example embodiment, the first step panel 402 is coupled to the second step panel 404 via multiple rotation hubs 407 and a rotation axle 406 extending through at least a portion of each of the rotation hubs 407. In this example, the first step panel 402 rotates with respect to the second step panel 404 and vice-versa about an axis defined by the longitudinal axis of the rotation axle 406. In other example embodiments, the platform step 250 can be a single step panel.

The top surface of each of the first step panel 402 and the second step panel 404 can be flat, substantially flat, or generally flat and in some example embodiments can be textured in some way or can include grooves or channels cut into the top surface to increase friction. For example, each of the first step panel 402 and second step panel 404 can also include means for increasing friction along the top surface of each. These friction increasing means can include, but are not limited to, raised studs, raised strips, friction tape, a friction increasing coating or material disposed along the top surface of each, and/or indentations or channels carved into the top surface of each.

The first step panel 402 can also include one or more attachment hooks 410 disposed along the bottom side 417 of the first step panel 402. For example, the first step panel 402 can include one or more generally L-shaped hooks that extend vertically downward from the bottom side 417 of the first step panel 402 to removably couple the first step panel 402 to the rear crossbeam support member 114. Each attachment hook 410 can be sized and shaped to define a channel 421 between the bottom end of the hook 410 and the bottom side 417 of the first step panel 402 that can receive a portion of the rear crossbeam support member 114 therein such that the bottom side 417 of the first step panel 402 can rest along the top of the rear crossbeam support member 114.

The second step panel 404 can include one or more attachment channels 412 disposed along the bottom side 419 of the second step panel 404. For example, the second step panel 404 can include a first attachment channel 412 along a first lateral side of the second step panel 404 and a second attachment channel 412 along a second lateral side of the second step panel 404 opposite the first lateral side. Each channel 412 can have a shape corresponding to a portion of the HAM crossbeam support member 136 and/or the first seat attachment housing 143 and the second seat attachment housing 141 along the bottom side 419 of the second step panel 404. The channels 412 can extend along at least a portion of the width of the second step panel 404 and can be sized and shaped to receive at least a portion of the HAM crossbeam support member 136 (e.g., the top portion) and/or a portion of a respective one of the first seat attachment housing 143 and the second seat attachment housing 141 (e.g., a top portion) therein, such that the second step panel 404 rests along the top of the HAM crossbeam support member 136 and/or the top of the first seat attachment housing 143 and the second seat attachment housing 141. In one example, the channel 412 has a shape configured to receive a top portion of the corresponding first seat attachment housing 143 and the second seat attachment housing 141 therein.

The second step panel 404 can also include a panel release latch 414. In one example, the panel release latch 414 is disposed along the bottom side 419 of the second step panel 404. The panel release latch 414 can move (e.g., slide, rotate, etc.) with respect to the second step panel 404. The panel release latch 414 can include a spring or other biasing means 418 to spring-bias the panel release latch 414 into a first position. A user can manually grip and move the panel release latch 414 from the first position to a second position to cause the panel release latch 414 to release the HAM crossbeam support member 136. In the first position, the panel release latch 414 can capture at least a portion of the HAM crossbeam support member 136 between the panel release latch 414 and the bottom side 419 of the second step panel 404. In the second position, the panel release latch 414 moves to release the HAM crossbeam support member 136 and allow the second step panel 404 to be lifted vertically.

In certain example embodiments, the platform step 250 can also include one or more apertures (not shown) extending through at least a portion of the second step panel 404 for routing webbing (e.g., straps, belts, etc.) therethrough. The webbing can be used to hold the platform step 250 in place under the booster seat base 120 when the platform step 250 is being stored.

Returning to FIGS. 2A-2B, in one example, the removable platform step 250 can be attached to the foldable stand 102 by placing the first step panel 402 along the rear crossbeam support member 114 and moving the removable platform step 250 towards the front leg stand 108 until the rear crossbeam support member 114 enters or seats in the channel 417 of each of the hooks 410. If still folded, the removable platform step 250 can then be unfolded such that the second step panel 404 can be rotated with respect to the first step panel 402 via the hubs 407 and axle 406 until the bottom side 419 of the second step panel 404 contacts the top surface of each of the corresponding first seat attachment housing 143 and the second seat attachment housing 141 and/or the HAM crossbeam support member. As the panel release latch 414 contacts the HAM crossbeam support member 136, the HAM crossbeam support member 136 will cause the panel release latch 414 to move with respect to the rest of the second step panel 404 towards the second position and provide access to the channel 412 of the second step panel 404. The HAM crossbeam support member 136 can enter or seat in the channel 412 and the spring-biasing of the panel release latch 414 will cause it to move back into the first position to retain at least a portion of the HAM crossbeam support member 136 between the bottom side of the second step panel 404 and the panel release latch 414. In example embodiments where the platform step 250 is a single piece rather than two pieces, the method of attaching the platform step 250 to the foldable stand 102 would be substantially the same other than the step of unfolding the platform step 250 would not be completed. Once the platform step 250 is coupled to the foldable stand 102, the platform step 250 provides a second step on the foldable stand 102 in the step-stool configuration that is at a vertical elevation that is higher than the fixed platform step 118.

In an alternative embodiment, the platform step 250 can be fixedly coupled to the foldable stand 102. For example, the platform step 250 can extend between and be coupled to the first leg 106A and the second leg 106B and can extend between and be coupled to the first leg 108A and the second leg 108B. In this alternative embodiment, the user can fold the foldable stand 102 by folding the platform step 250 (e.g., by folding the first step panel 402 with respect to the second step panel 404), which would pull the front leg stand 108 and the rear leg stand 106 towards one another.

In another alternative embodiment, rather than having the rear crossbeam support member 114 and the HAM crossbeam support member 136, the foldable stand 102 could include a left crossbeam support member that extends from and is fixedly coupled along one end to the first leg 106A of the rear leg stand 106 and along the other end to the first leg 108A of the front leg stand 108. The foldable stand 102 could also include a right crossbeam support member that extends from and is fixedly coupled along one end to the second leg 106B of the rear leg stand 106 and along the other end to the second leg 108B of the front leg stand 108. The elements of the platform step 250 could then essentially be rotated 90 degrees about the vertical axis to removably couple the platform step 250 to the left crossbeam support member and the right crossbeam support member.

In yet another alternative embodiment, rather than having the rear crossbeam support member 114 and the HAM crossbeam support member 136, the platform step 250 can include a multitude of retractable pins than can extend out from a perimeter of the platform step 250. Each retractable pin can be removably inserted into corresponding holes or apertures provided at the desired position along each of the first leg 106A and second leg 106B of the rear leg stand 106 and the first leg 108A and second leg 108B of the front leg stand 108. The pins can be spring-biased to extend out from the perimeter of the platform step and can be manually adjustable (e.g., by way of a switch, button, lever or the like) by a user to retract so as to be removable from the apertures in the legs.

In yet another alternative embodiment, the platform step 250 could include multiple magnets. The platform step 250 could then be removably coupled to the rear crossbeam support member 114 and HAM crossbeam support member 136, or the left crossbeam support member and the right crossbeam support member, or the legs 106A, 106B, 108A, 108B by magnetically coupling the platform step 250, via the magnets.

In yet another alternative embodiment, the legs 106A, 106B, 108A, 108B could include one or more slots, cut-outs, or cavities and the platform step 250 can be removably coupled to the foldable stand 102 by slidably inserting the platform step into and/or along the one or more slots, cut-outs, or cavities. In yet another alternative embodiment, the platform step 250 could include its own separate and distinct legs upon which the platform step 250 could rest and could nest within the foldable stand 102.

In yet another alternative embodiment, the foldable stand 102 could be further disassembled for use as another type of step stool. For example, an upper portion of each of the legs 106A, 106B, 108A, 108B could be detachable from a lower portion of each at a position above where the platform step 250 is removably coupled to the foldable stand 102. This would provide a step stool with a lower profile and less of the safety features (e.g., the support member 132 and the upper portions of the legs along the sides of the step stool, that would be beneficial for smaller children.

To adjust the convertible high-chair and step stool 100 from the step stool configuration to the high-chair configuration, the user can grasp and push, pull, or otherwise move (e.g., slide, rotate, etc.) the panel release latch 414 to release the HAM crossbeam support member 136 from the panel release latch 414. The user can then slide the platform step 250 in a direction towards the rear leg stand to remove the rear crossbeam support member 114 from the channels 421 in the hooks 410 along the bottom side 417 of the first step panel 402. The platform step 250 is now separated from the HAM 134 and can be placed to the side. The user can then manually apply a force to each of the release levers of the spring-biased locking tabs 220 on each HAM housing 202, 204 to disengage the corresponding tab ends 224 of each spring-biased locking tab 220 from the corresponding apertures or indentations in the corresponding legs 108A, 108B. The user can then apply a generally upward force on the HAM 134 to slide it along the longitudinal axes X of the legs 108A, 108B in a generally upward direction B. In one example, the HAM 134 is slidably adjusted in the direction B until the desired height for the booster seat 104 is reached or a portion of at least one of the first HAM housing 202 and second HAM housing 204 contact one of the rotation hubs 128, 130 (e.g., the maximum vertical position). The user can then release or discontinue applying a force to each of the release levers of the spring-biased locking tabs 220. The spring-biasing force on each of the spring-biased locking tabs 220 will cause each tab end 224 to rotate into contact with the corresponding legs 108A, 108B and/or the tab ends 211 to be inserted into the corresponding apertures or indentations along the respective legs 108A, 108B to prevent the HAM 134 from sliding back down the longitudinal axes X of the legs 108A, 108B. The tabs or bayonets 146 on the booster seat 104 can then be inserted into the corresponding first receiving slot 144 and second receiving slot 142 of the HAM 134 as discussed above. Further, the platform step 250 can be folded and slidably inserted into the channels 152, 154 and up against the storage backstop 137 of the HAM 134 for storage of the platform step 250 while not in use.

In an alternative embodiment, rather than providing the channels 152, 154 on the first housing and second housing of the HAM 134 for storing the platform step 250 while not in use, the bottom side of the booster seat base 120 can include one or more elongated rails. The platform step 250 can include one or more guide members sized and shaped to fit within the one or more elongated rails to slidably couple the platform step 250 to the booster seat base 120 for storage. In another alternative embodiment, a mesh bag can be disposed along the bottom side of the booster seat base 120. The platform step 250 can be placed within the mesh bag for storage when not in use.

In yet another alternative embodiment, the booster seat base 120 could be eliminated and the platform step 250 can be fixedly coupled to the HAM 134 such that when the HAM 134 is adjusted into the raised position along the front leg stand 108, the platform step 250 can act as the booster seat base and the seat back 122, foot rest 124, and/or the tray 126 can be removably coupled to the platform step 250.

In another alternative embodiment, the foot rest 124 can be fixedly coupled to the front leg stand 108 rather than being removably coupled to the booster seat base 120. In yet another alternative embodiment, the foot rest 124 can be eliminated. In place of the foot rest 124, the fixed platform step 118 can be fixedly coupled to the HAM 134 rather than the front leg stand 108. In this example, when the HAM is adjusted into the raised position, the fixed platform step 118 can be positioned at a vertical height less than that of the booster seat base 120 and the fixed platform step 118 can act as the foot rest when the child is positioned in the booster seat 104.

The foldable stand 102 is also foldable to reduce its profile and make it easier to store. When in the high-chair configuration or with the booster seat 104 and the removable platform step 250, the front leg stand 108 can be rotated about an axis of rotation defined through the first rotation hub 128 and the second rotation hub 130 to rotate towards and then optionally abut the rear leg stand 106. In the folded configuration, each of the front leg stand 108 and rear leg stand 106 can extend down from the hubs 128, 130 substantially the same distance so that the foldable stand can rest on a floor surface via the base panel 110 and the base panel 112 at the same time.

Though the disclosed examples include particular arrangements of a number of parts, components, features, and aspects, the disclosure is not limited to only those examples or arrangements shown. Any one or more of the parts, components, features, and aspects of the disclosure can be employed alone or in other arrangements of any two or more of the same.

Although certain high-chair and step stool features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. An apparatus comprising:

a stand comprising a front leg stand; and a rear leg stand configured to rotate with respect to the front leg stand;

a height adjustment mechanism movably coupled to the stand and adjustable from a first vertical position to a second vertical position along the stand;

a booster seat removably coupled to the height adjustment mechanism in the first vertical position; and a first platform step removably coupled to the height adjustment mechanism and the stand in the second vertical position, wherein the first platform step abuts and is supported by a first crossbeam support member and a second crossbeam support member, the first crossbeam support member extending between a first leg and a second leg of the front leg stand, and the second crossbeam support member coupled to the rear leg stand, wherein the apparatus is adjustable from a high-chair to a step stool.

2. The apparatus of claim 1, wherein the height adjustment mechanism is movably coupled to at least one of the front leg stand and the rear leg stand.

3. The apparatus of claim 2, wherein the height adjustment mechanism comprises:

a first housing defining a first cavity for receiving a first portion of one of the front leg stand and the rear leg stand therethrough;

a second housing defining a second cavity for receiving a second portion of one of the front leg stand and the rear leg stand therethrough; and a crossbeam support member comprising a first end coupled to the first housing and a distal second end coupled to the second housing.

4. The apparatus of claim 3, wherein the booster seat further comprises:

a booster seat base comprising a front end, a rear end, a first lateral side, and a second lateral side;

a seat back coupled to the booster seat base along the rear end;

a first tab extending from the first lateral side; and a second tab extending from the second lateral side;

wherein the height adjustment mechanism further comprises:

a first booster seat receiving slot configured to receive the first tab; and a second booster seat receiving slot configured to receive the second tab.

5. The apparatus of claim 2, wherein the height adjustment mechanism is slidably adjustable along the first leg and the second leg of the front leg stand.

6. The apparatus of claim 2, wherein the rear leg stand comprises a first leg and a second leg and wherein the height adjustment mechanism is slidably adjustable along the first leg and the second leg of the rear leg stand.

7. The apparatus of claim 2, wherein the stand further comprises:

a first rotation hub comprising a first rotation portion coupled to the front leg stand and a second rotation portion coupled to the rear leg stand; and a second rotation hub comprising a third rotation portion coupled to the front leg stand and a second rotation portion coupled to the rear leg stand.

8. The apparatus of claim 1, wherein the first platform step comprises:

a first step panel configured to be removably coupled to the height adjustment mechanism;

a second step panel coupled to the first step panel and rotatable with respect to the first step panel, the second step panel configured to be removably coupled to the stand; and a panel release latch rotatably coupled to the second step panel.

9. The apparatus of claim 1, wherein the first platform step is adjustable from a folded configuration to an unfolded configuration, wherein the height adjustment mechanism further comprises a storage area, and wherein the first platform step is configured to be inserted into the storage area of the height adjustment mechanism in the folded configuration.

10. The apparatus of claim 1, wherein the stand further comprises a first wheel assembly along a first lateral side of the stand and a second wheel assembly along a second lateral side of the stand, wherein each of the first wheel assembly and the second wheel assembly comprises a wheel and a fender assembly surrounding at least a portion of an outer perimeter of the wheel.

11. The apparatus of claim 10, wherein each fender assembly comprises a first end comprising a foot configured to abut a floor surface and a distal second end comprising an anti-rollaway foot, wherein a gap in the fender assembly between the foot and the anti-rollaway foot defines a rolling window for the wheel and wherein the foot and the anti-rollaway foot are disposed less than substantially 25 degrees apart along the outer perimeter of the wheel.

12. A method of converting an apparatus between a high-chair and a step stool comprising:

providing a convertible high-chair comprising:

a stand comprising:
a front leg stand;
a first crossbeam support member extending between a first leg and a second leg of the front leg stand;
a rear leg stand rotatable with respect to the front leg stand; and
a second crossbeam support member coupled to the rear leg stand;
a booster seat removably coupled to the stand; and
a first platform step adjustable with respect to the stand;
decoupling the booster seat from the stand; and
adjusting the first platform step to abut and be supported by the first crossbeam support member and the second crossbeam support member.

13. The method of claim 12, further comprising:
decoupling the first platform step from the first crossbeam support member; and
removably coupling the booster seat to the height adjustment mechanism.

14. The method of claim 13, wherein the convertible high chair further comprises a height adjustment mechanism comprising a storage area and wherein the method further comprises slidably inserting the first platform step into the storage area of the height adjustment mechanism.

15. An apparatus comprising:
a stand comprising
a front leg stand; and
a rear leg stand configured to rotate with respect to the front leg stand;
a booster seat configured to be removably coupled to the stand;
a first platform step adjustable with respect to the stand and configured to be coupled to the stand, wherein the first platform step abuts and is supported by a first crossbeam support member and a second crossbeam support member, the first crossbeam support member extending between a first leg and a second leg of the front leg stand, and the second crossbeam support member coupled to the rear leg stand,
wherein the apparatus is adjustable from a high-chair configuration, wherein the booster seat is coupled to the stand, to a step stool configuration, wherein the booster seat is decoupled from the stand.

16. The apparatus of claim 15,
wherein the front leg stand further comprises:
a second platform step extending from the first front leg to the second front leg; and
wherein the rear leg stand comprises:
a first rear leg;
a second rear leg; and
the second crossbeam support member extending from the first rear leg to the second rear leg.

17. The apparatus of claim 16, wherein the first platform step comprises at least one channel disposed along a bottom side of the first platform step and wherein the second crossbeam support member is disposed through the at least one channel.

18. The apparatus of claim 16, wherein in the step stool configuration, the first platform step extends from the first crossbeam support member to the second crossbeam support member and a bottom side of the first platform step abuts the first crossbeam support member and the second crossbeam support member.

19. The apparatus of claim 15, wherein the stand further comprises:
a first rotation hub comprising a first rotation portion coupled to the front leg stand and a second rotation portion coupled to the rear leg stand; and
a second rotation hub comprising a third rotation portion coupled to the front leg stand and a second rotation portion coupled to the rear leg stand.

20. The apparatus of claim 15, wherein the first platform step is configured to be either permanently coupled to or removably coupled to the stand.

21. An apparatus comprising:
a stand comprising
a front leg stand; and
a rear leg stand configured to rotate with respect to the front leg stand;
a child seat configured to be removably coupled to the stand; and
a first platform step, wherein the first platform step abuts and is supported by a first crossbeam support member and a second crossbeam support member, the first crossbeam support member extending between a first leg and a second leg of the front leg stand, and the second crossbeam support member coupled to the rear leg stand,
wherein the apparatus is adjustable from a high-chair configuration, wherein the child seat is coupled to the stand, to a step stool configuration, wherein the child seat is decoupled from the stand.

22. The apparatus of claim 21,
wherein the front leg stand further comprises:
a second platform step extending from the first front leg to the second front leg; and
wherein the rear leg stand comprises:
a first rear leg;
a second rear leg; and
the second crossbeam support member extending from the first rear leg to the second rear leg.

* * * * *